United States Patent [19]

Wadsworth

[11] 4,084,718

[45] Apr. 18, 1978

[54] COMPRESSION SEAL FOR ELASTOMERIC SEPTUM

[75] Inventor: Brent Earl Wadsworth, Concord, Calif.

[73] Assignee: Varian Associates, Inc., Palo Alto, Calif.

[21] Appl. No.: 772,611

[22] Filed: Feb. 28, 1977

[51] Int. Cl.[2] ..... B65D 41/20

[52] U.S. Cl. ..... 215/247; 210/198 C; 220/277

[58] Field of Search ..... 215/31, 247, 248, 249, 215/DIG. 1, 349; 210/198 C, 233; 220/277

[56] References Cited

U.S. PATENT DOCUMENTS

| | | | |
|---|---|---|---|
| 2,080,144 | 5/1937 | Lufkin | 215/349 X |
| 2,135,386 | 11/1938 | Crabbe | 215/247 |
| 2,848,130 | 8/1958 | Jesnig | 215/247 X |
| 2,958,439 | 11/1960 | Yochem | 215/DIG. 1 |
| 3,387,609 | 6/1968 | Shields | 215/247 X |
| 3,424,329 | 1/1969 | Hershberg | 215/247 |
| 3,460,702 | 8/1969 | Andrews | 215/247 |
| 3,551,273 | 12/1970 | McKinney | 215/247 X |

FOREIGN PATENT DOCUMENTS

| | | | |
|---|---|---|---|
| 162,520 | 4/1955 | Australia | 215/DIG. 1 |
| 86,014 | 8/1955 | Norway | 215/349 |
| 401,631 | 11/1933 | United Kingdom | 215/31 |

*Primary Examiner*—Donald F. Norton

*Attorney, Agent, or Firm*—Stanley Z. Cole; John J. Morrissey

[57] ABSTRACT

A sealing fixture in combination with a cap member provides a fluid-tight compression seal between an elastomeric septum and a tubular body. The septum is disposed transversely on a first end of the sealing fixture, which is of cylindrical configuration with an axial bore. A second end of the sealing fixture fits over the tubular body. The cap member covers the septum by being screwed down over a threaded portion of the outer wall of the sealing fixture. An aperture is provided in the cap member through which an injection device can be inserted to puncture the septum so as to deliver a quantity of fluid to, or to remove a quantity of fluid from, the tubular body via the bore in the sealing fixture. An outer wall portion of the sealing fixture adjacent the first end thereof is tapered inwardly to form a sharp junction with an inner wall portion of the sealing fixture. This inner wall portion adjacent the first end of the sealing fixture is parallel to the axis of the bore. As the cap member is screwed down over the first end of the sealing fixture, the sharp junction cuts into the septum. An edge portion of the septum overhanging the junction is compressed between the cap member and the tapered outer wall portion of the sealing structure, thereby providing a compression seal while leaving the central portion of the septum relatively stress free.

4 Claims, 3 Drawing Figures

COMPRESSION SEAL FOR ELASTOMERIC SEPTUM

BACKGROUND OF THE INVENTION

In the prior art, the techniques for providing a gas-tight seal between a tubular container and a plastic or elastomeric septum have generally involved either pressing the flat blunt end of the tube against the septum, or compressing the septum and inserting it inside the end of the tube so that the resulting expansion of the septum against the walls of the tube produces a sealing effect.

It has been found, however, that such techniques are not adequate for high-pressure chromatographic applications. Inadequate sealing may still occur when the septum is simply pressed against the blunt end. When using thin-bore tubular containers, where the septum is to be inserted inside the end of the tube, the tube must necessarily be large enough to accommodate the compressed septum. This imposes a lower practical limit on the size of the bore that can be conveniently used. Thus, heretofore, whether the septum was inserted inside the tube, or was pressed over the end of the tube, it was found that the temperature cycling utilized in chromatographic applications often caused shrinkage, and hence leakage, of the septum.

SUMMARY OF THE INVENTION

It is a general object of this invention to provide a fluid-tight seal between a tubular container (e.g., a sample container for use in chromatographic applications) and a septum covering the bore of the container, where the septum is made of a plastic or elastomeric material suitable for withstanding repeated puncturing by a hypodermic needle for the purpose of withdrawing sample liquid from the container.

It is a particular object of this invention to provide such a seal, wherein the liquid-tight integrity is not affected by the temperature cycling normally encountered in chromatographic applications.

It is also a particular object of this invention to provide such a seal, wherein the central portion of the septum that is punctured during withdrawal of liquid from the container is relatively free of stresses caused by the mounting of the septum over the bore of the container.

It is another object of this invention to provide a sealing fixture, which may be mounted over the top of a tubular liquid container so as to accomplish the general object of this invention.

More particularly, it is the object of this invention to provide a sealing fixture that fits over the end of a tubular container, and which is screw-threaded on its outer wall to receive a mating cap structure, whereby the screwing of the cap structure onto the sealing fixture causes the septum to form a fluid-tight seal over the bore of the container.

In a particular embodiment of this invention, the sealing fixture is a metallic cylindrical structure having an axial bore. At one end thereof, the bore is configured with a diameter sufficient to allow the fixture to be snugly fitted over the end of the tubular container. Near the other end of the fixture, the outer wall thereof tapers inwardly to form a circular junction with the inner wall thereof. The junction provides a relatively sharp circular cutting edge, which need not be razor-sharp but may be slightly blunt. However, it is necessary that actual cutting of the septum by the edge occur, rather than merely a pressing of the edge into the surface of the septum. The septum is disposed transversely upon the junction so as to cover the bore of the sealing fixture. The outer wall of the sealing fixture is screw-threaded to receive a matingly threaded cap structure. The cap structure fits over the septum, and the screwing of the cap structure onto the sealing fixture causes the septum to be compressed against the cutting edge of the sealing fixture. The outer rim portion of the septum, which is compressed between the tapering outer wall of the sealing fixture and the inner wall of the cap structure, is compressed into a very small volume and thereby provides a fluid-tight seal between the sealing fixture and the cap structure in the manner of a compressed O-ring. The central portion of the septum is left relatively stress free, and is therefore better able to withstand repeated puncturing by a hypodermic needle. An aperture is provided in the cap structure in alignment with the central bore of the sealing fixture to permit entry of the hypodermic needle into the tubular container.

DESCRIPTION OF PREFERRED EMBODIMENTS

Figure 1:
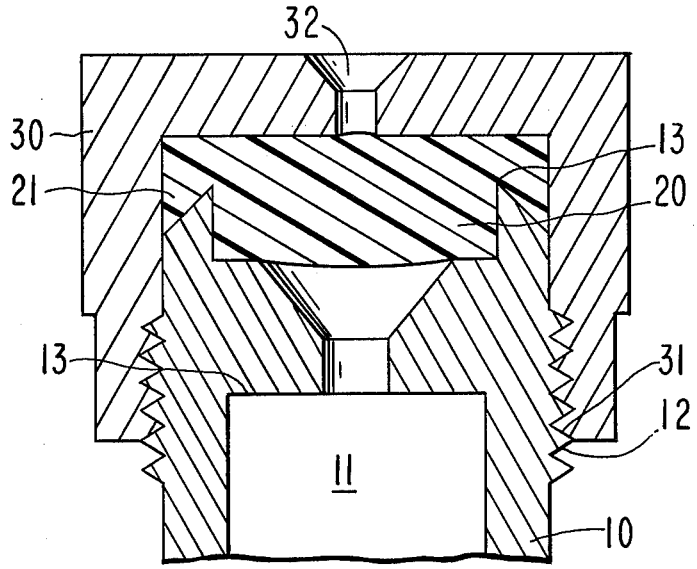
FIG. 1 shows a sectional view of a particular embodiment of the liquid-tight seal according to the invention.

As seen in FIG. 1, a sealing fixture 10 of generally cylindrical configuration has an axial bore therethrough. One end of the fixture 10 has a recessed cavity 11 with an inside diameter of a size suitable to permit the fixture to be mounted over the end of a tubular structure, such a sample-liquid containing vial or column injection device of the kind used in chromatography. The outside wall of the fixture 10 is provided with screw threads 12. The other end of the fixture 10 is configured so that the outer wall thereof tapers ipwardly to form a generally circular junction 13 with the inner wall thereof. This circular junction 13 provides a relatively sharp cutting edge, which need not be razor sharp but may be slightly blunt. The junction edge 13 should be sharp enough, however, to cut into a septum 20 that is compressed against it.

The septum 20 is made of a plastic or elastomeric material that may withstand repeated puncturing by a hypodermic needle. The septum 20 is of generally circular cross-section with a diameter greater than that of the circular junction 13, so that a rim portion 21 of the septum 20 extends beyond the junction 13 when the septum 20 is disposed coaxially atop the fitting 10.

A cap structure 30 is configured to fit over the septum 20 atop the fitting 10. The inside wall of the cap structure 30 is provided with screw threads 31, which mate with the screw threads 12 on the outside wall of the fixture 10, thereby permitting the cap structure to be screwed onto the fixture 10. Screwing of the cap structure 30 onto the fixture 10 causes the septum 20 to be compressed against the cutting edge of the junction 13. The outer rim portion 21 of the septum 20 is thereupon compressed into a very small volume between the tapering outer wall of the fixture 10 and the inner wall of the cap structure 30, thereby providing a leak-tight seal therebetween in the manner of a compressed O-ring. The central portion of the septum 20 is left relatively stress free, and is therefore better able to withstand repeated puncturing by a hypodermic needle. An aperture 32 is provided in the cap structure 30 in alignment with the central bore of the fixture 10 to permit entry of a hypodermic needle into the tubular container over which the fixture 10 is fitted.

In the embodiment shown in FIG. 1, contact between the septum 20 and the end of the tubular structure to be covered by the septum is prevented by an annular protrusion 13 within the fixture 10. Where it is not desirable to let any compression force that is exerted by the cap 30 on the septum 20 be transmitted directly to the interior of the cavity 11, the embodiment shown in FIG. 1 is preferred.

Figure 2:
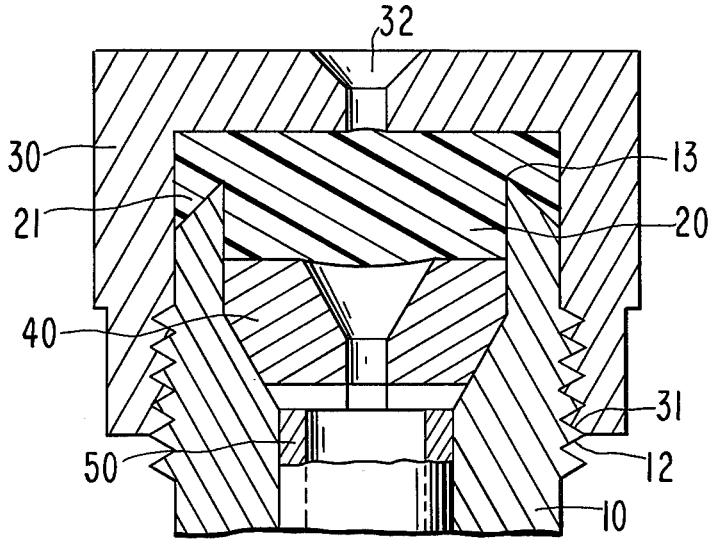
FIG. 2 shows a sectional view of an alternative embodiment of the liquid-tight seal according to this invention.

An alternative configuration for the sealing fixture 10 is shown in FIG. 2, wherein the central bore at the end thereof adjacent the septum 20 is configured to permit a backup washer 40 to be disposed between the septum 20 and the end of the tubular structure 50. The end of the tubular structure 50 thus comes into contact with the backup washer 40 rather than directly into contact with the septum 20.

Figure 3:
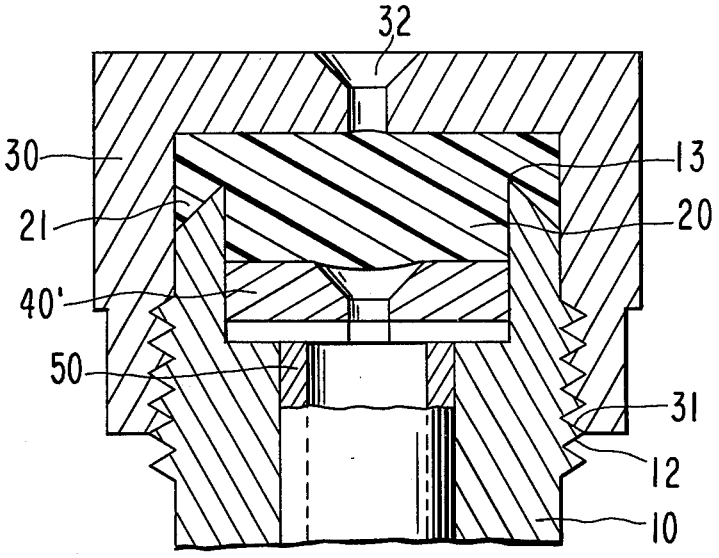
FIG. 3 shows a sectional view of another alternative embodiment of the liquid-tight seal according to this invention.

Another alternative configuration for the sealing fixture 10 is shown in FIG. 3, wherein the central bore at the end thereof adjacent the septum 20 is configured to permit a backup washer 40' to be disposed between the septum 20 and the end of the tubular structure 50. The washer 40' of FIG. 3 is of a different configuration from the washer 40 shown in FIG. 2, the principal advantage of the configuration of the washer 40' being that such a right-circular cylindrical configuration is generally easier to manufacture. The configuration of washer 40, however, provides a shorter horizontal interface between the backup washer and the inside surface of the fixture 10, thereby providing a smaller region for quantities of sample fluid to become trapped. A backup washer configuration that is most advantageous for the particular application contemplated may be used.

The invention has been set forth herein in terms of specific embodiments. Clearly, various other configurations will be suggested by the particular applications for which this invention may be used. For example, the cavity 11 as shown in the Figures, may represent a closed container rather than an open tube. Another example would be an open tubular device such as a chromatographic injector. Thus, the embodiments shown herein are to be considered as illustrative and not limiting. The invention is limited only by the scope of the following claims.

What is claimed is:

1. In combination, a sealing fixture, an elastomeric septum, and a cap member;

said sealing fixture being of generally cylindrical configuration and having an axial bore therethrough, a first end of said sealing fixture being configured to receive a fluid transfer device within said bore, and a second end of said sealing fixture being configured to receive an open end of a hollow structure within said bore, whereby a quantity of fluid can be transferred between said fluid transfer device and said hollow structure via said bore, an outer wall portion of said sealing fixture adjacent said first end of said sealing fixture being tapered inwardly to form a junction with an inner wall portion of said sealing fixture, said inner wall portion adjacent said first end of said sealing fixture being substantially parallel to the axis of said cylindrical sealing fixture, said junction being sharp enough to cut into said septum when said septum is pressed against said junction, a nontapered outer wall portion of said sealing fixture being threaded, said threaded outer wall portion being intermediate said tapered outer wall portion and said second end of said sealing fixture;

said septum being of generally cylindrical configuration and being disposed coaxially with respect to said sealing fixture in contact with said junction, the perimeter of said septum extending beyond said junction so that a rim portion of said septum lies outside said junction;

said cap member being configured to cover said septum by being threadably received over said threaded outer wall portion of said sealing fixture, whereby said junction cuts into said septum and said rim portion of said septum is compressed between said cap member and said tapered outer wall portion of said sealing fixture when said cap member is screwed down onto said sealing fixture, said cap member having an aperture through which said fluid transfer device can be inserted into said bore of said sealing fixture by puncturing said septum.

2. The combination of claim 1 wherein said junction is generally circular.

3. The combination of claim 2 wherein said septum is of generally circular transverse cross section, the diameter of said septum being larger than the diameter of said junction.

4. The combination of claim 1 further comprising a washer of generally cylindrical configuration and having an axial bore, said washer being disposed coaxially within said inner wall portion of said sealing fixture adjacent said first end thereof.

* * * * *